United States Patent [19]

Ortize

[11] 4,062,586

[45] Dec. 13, 1977

[54] HANGING CHAIR

[76] Inventor: Eileen S. Ortize, P.O. Box 585, Pawleys Island, S.C. 29585

[21] Appl. No.: 733,923

[22] Filed: Oct. 19, 1976

Related U.S. Application Data

[63] Continuation-in-part of Ser. No. 648,106, Jan. 9, 1976, Pat. No. 4,002,368.

[51] Int. Cl.[2] ..... A47C 15/00; A47C 5/02

[52] U.S. Cl. ..... 297/248; 5/120; 297/232; 297/281; D6/53

[58] Field of Search ..... 5/120, 122; 224/9; 297/232, 248, 273, 281, 282, 457

[56] References Cited

U.S. PATENT DOCUMENTS 1,515,263 11/1924 Matsusaki ..... 5/120

2,722,968 11/1955 Smith ..... 5/122 X

FOREIGN PATENT DOCUMENTS 436,606 11/1967 Switzerland ..... 297/457

*Primary Examiner*—James C. Mitchell

*Attorney, Agent, or Firm*—Bacon & Thomas

[57] ABSTRACT

A hanging chair for use in conjunction with an overhead support wherein the chair includes at least one flexible seat having a substantially trapezoidal configuration with the shorter parallel side forming the back portion of the chair, the longer parallel side forming the front portion of the chair and the two non-parallel sides forming the side portions of the chair. Frame members maintain the side portions of the chair in a stretched condition so that an occupant may easily enter and leave the chair from the front portion thereof.

10 Claims, 5 Drawing Figures

HANGING CHAIR

CROSS-REFERENCE TO RELATED APPLICATION

This application is a continuation-in-part of earlier application Ser. No. 648,106 filed on Jan. 9, 1976 and now U.S. Pat. No. 4,002,368.

BACKGROUND OF THE INVENTION

1. Field of the Invention

The present invention generally involves chairs and related furniture structures. More particularly, the present invention relates to the field of prior art pertaining to chairs or seating devices which are utilized by hanging them from overhead or equivalent supports.

2. Description of the Prior Art

It has long been known that chairs and related devices for supporting the human body may be supported off of the floor or ground surface. The simple playground swing and the basic hammock structure are examples of this concept. However, these and related devices are primarily utilized in a recreational or casual manner and are incapable of providing the necessary comfort and support generally found in chairs and other seating devices of a more conventional nature.

Though the prior art has recognized the need for a hanging chair which combines the best advantages of recreation and seating comfort, all heretofore known prior attempts to satisfy this need have been deemed lacking in one respect or another. For example, it is known to provide a rigid chair structure made of metal or wood and merely suspend such structure by a pair of chains or ropes from an overhead support. Such a rigid hanging chair is generally uncomfortable for prolonged seating and is dangerous due to the unavoidable swinging action. It is also know to provide for hanging chairs or swings made from flexible or woven material. These manifestations are generally based upon the doubling up of a hammock structure which serves to support the occupant within a pendulous sack-like configuration. It is impossible for the occupant to derive adequate support, particularly for his back, while seated in this latter type of hanging chair.

SUMMARY OF THE INVENTION

It is an object of the invention to provide for a hanging chair which is of a casual and recreational nature while having the capability of safely and comfortably supporting the occupant therein for prolonged periods of time.

It is another object of the invention to provide for a hanging chair which is compact and may be easily and quickly attached to and removed from any suitable overhead support.

It is yet another object of the present invention to provide for a hanging chair which is simple in construction and economical to manufacture.

It is still yet a further object of the present invention to provide for a hanging chair which is adjustable and capable of conforming to the shape and size of the occupant.

The present invention serves to overcome the disadvantages and deficiencies inherent in prior art hanging chairs and achieves the foregoing objects by providing a hanging chair which includes at least one flexible seat portion having a substantially trapezoidal configuration wherein the shorter of the two parallel sides forms the back portion of the chair for enclosing and comfortably supporting the back of the user. The longer of the parallel sides forms the front portion of the chair and the two non-parallel sides form the side portions of the chair. Rigid frame members are provided for maintaining the side portions of the chair in a stretched condition in order to facilitate entry into and exit from the chair by the occupant. The chair also includes means carried by the seat for hanging the chair from any suitable overhead support.

Other objects, features and advantages of the present invention will be apparent from the following description of specific embodiments thereof, with reference to the accompanying drawings, which form a part of this specification, wherein like reference characters designate corresponding parts of the several views.

DETAILED DESCRIPTION OF THE PREFERRED EMBODIMENTS

Figure 1:
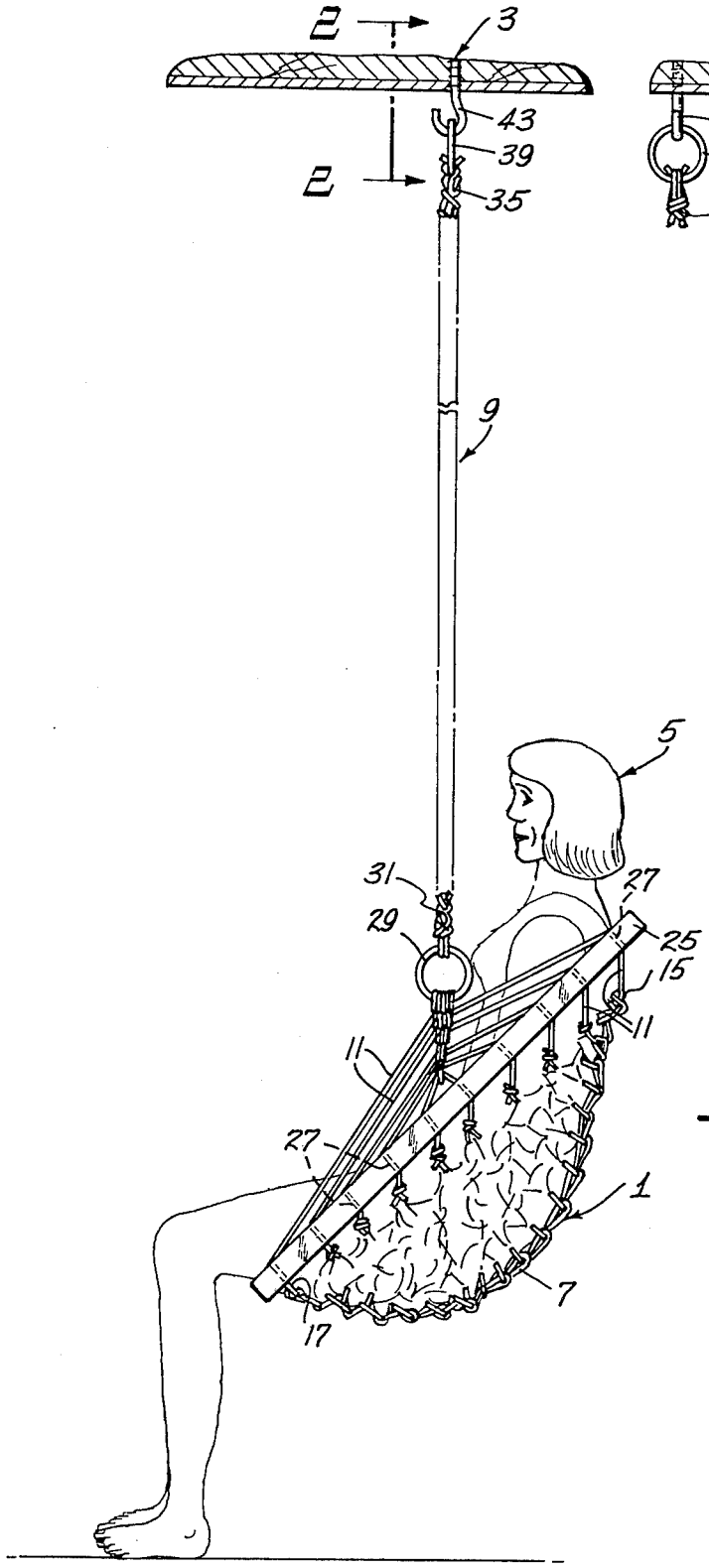
FIG. 1 is a side elevational view of one embodiment of the hanging chair of the present invention shown suspended from an overhead support and being utilized by an occupant.

Referring now to FIG. 1, there is shown a hanging chair 1, according to one embodiment of the present invention, suspended from an overhead support 3, such as a ceiling, and utilized by an occupant 5.

Chair 1 includes a flexible seat portion 7 and a hanging means 9 for suspending chair 1 from overhead support 3.

Figure 2:
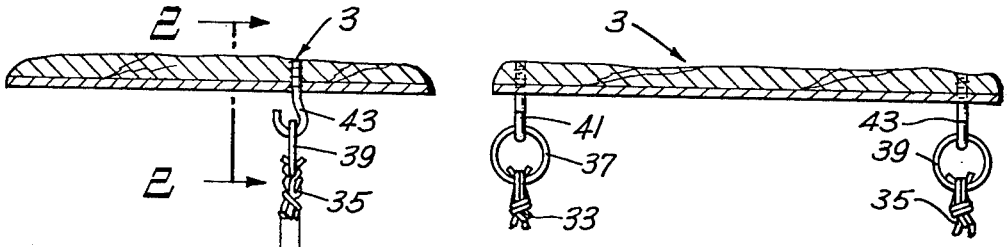
FIG. 2 is a sectional view taken along the line 2—2 of FIG. 1.
Figure 3:
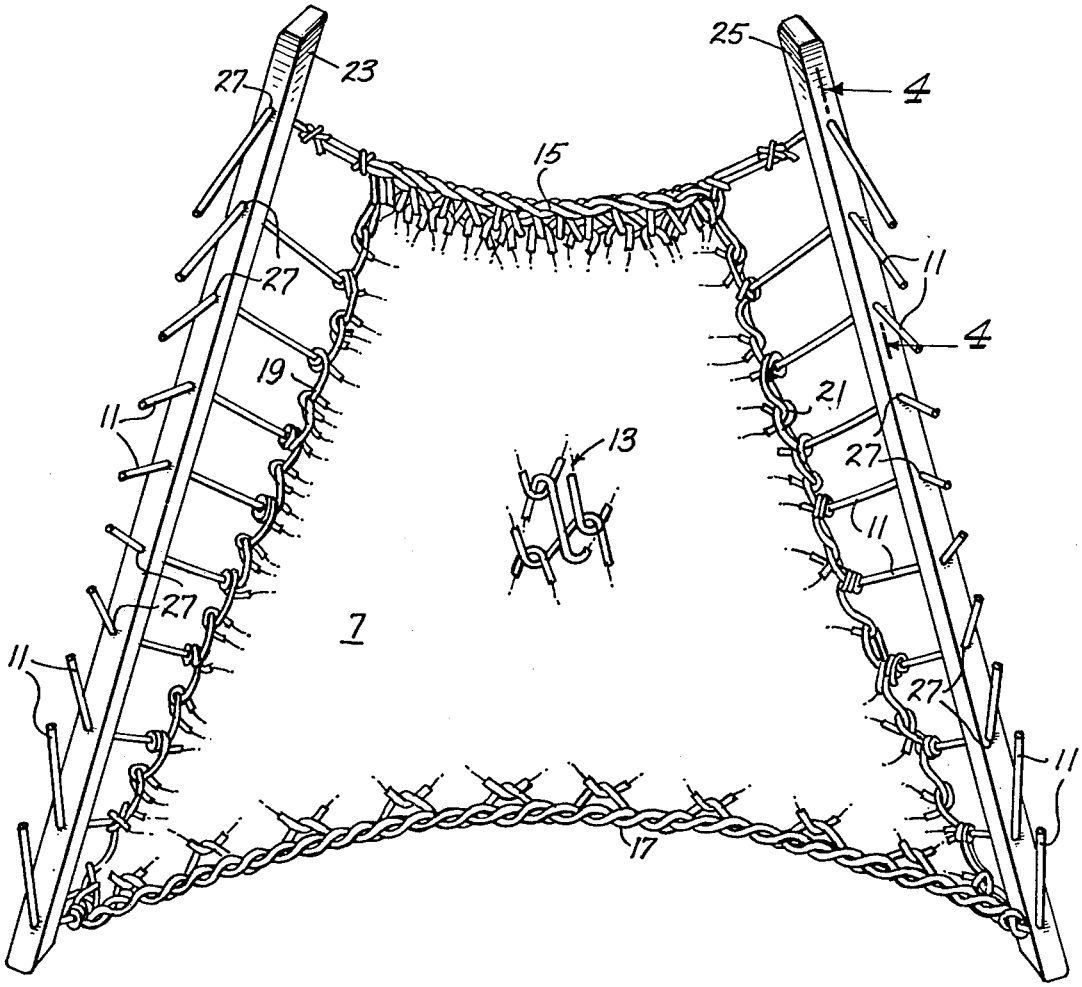
FIG. 3 is a plan view of the hanging chair of FIG. 1, shown partly in section and unoccupied.

As is more clearly depicted in FIGS. 2 and 3, seat portion 7 is preferably formed from a plurality of ropes 11 loosely woven in a bias weave manner as indicated generally at 13. Seat portion 7, when laid out flat, assumes a generally trapezoidal configuration having a short side 15 disposed substantially parallel with a longer side 17 and a pair of opposing non-parallel sides 19 and 21. It is preferred that non-parallel sides 19 and 21 be of substantially the same length, thereby imparting an overall isosceles trapezoidal configuration to seat portion 7. Because of the nature of bias weave 13, seat portion 7 is capable of expanding in all directions to thereby enclose and conform to both the size and shape of occupant 5. It is further preferred that sides 15 and 17 be formed from a four-handed braid in order to impart rigidity thereto.

The trapezoidal configuration of seat portion 7 serves to locate shorter parallel side 15 at the back portion of chair 1 and longer parallel side 17 at the front portion of chair 1. In this manner, occupant 5 may easily gain access into seat portion 7 because of the greater breadth of side 17. Once in seat portion 7, shorter parallel side 15 forming the back portion of chair 1 serves to provide firm and comfortable support by enclosing the back portion of occupant 5, as clearly shown in FIG. 1.

Figure 4:
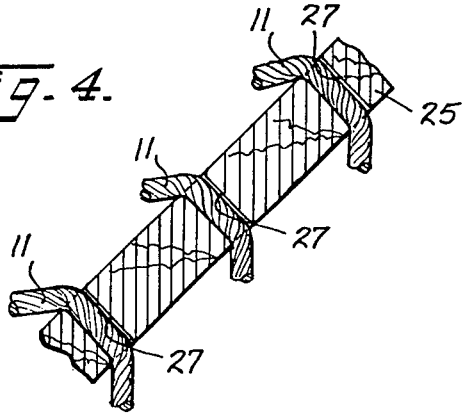
FIG. 4 is an enlarged fragmentary sectional view taken along the line 4—4 of FIG. 3.

A pair of rigid frame members 23 and 25 are provided for the purpose of maintaining non-parallel sides 19 and 21 of seat portion 7 in a stretched or expanded condition to further facilitate entry into chair 1 by occupant 5. Members 23 and 25 are preferably of elongate configuration. They may be secured adjacent sides 19 and 21 by providing a plurality of apertures 27 along the lengths thereof and passing portions or ropes 11 therethrough. This is more clearly depicted in FIG. 4. The free ends of ropes 11 extending through members 23 and 25 may be joined and secured to support rings, preferably of metal, located above and substantially intermediate the ends of members 23 and 25 as shown in FIG. 1. Though only a single ring 29 is depicted for member 25, it is to be understood that member 23 is also provided with its own corresponding support ring.

Hanging means 9 for suspending chair 1 is preferably made from a plurality of woven or braided ropes 31, which ropes 31 are preferably of the same physical structure and nature as that of ropes 11. As seen in FIG. 2, means 9 includes two braided rope portions 33 and 35 which are provided with support rings 37 and 39 at their ends. A pair of threaded hooks 41 and 43 may be screwed with overhead support 3 for receiving and supporting chair 1 through support rings 37 and 39. Accordingly, chair 1 may be quickly and easily attached to or removed from overhead support 3.

Because of the free and unrestricted manner in which ropes 11 are passed through apertures 27 in members 23 and 25, occupant 5 may adjust the conformity and comfort of chair 1 by sliding members 23 and 25 up and down with respect to ropes 11. As also shown in FIG. 3, members 23 and 25 serve to facilitate entrance into seat portion 7 by occupant 5 by virtue of their disposition which, because of the trapezoidal configuration of seat portion 7, converge from front side 17 towards back side 15.

Though the foregoing description of chair swing 1 of the present invention serves to detail one embodiment thereof, it is to be understood that various modifications and other embodiments are entirely possible within the scope and intent of the invention. For example, seat portion 7 may be made from any suitable flexible material, woven or unwoven, provided it assumes the general configuration of a trapezoid, preferably an isosceles trapezoid. Frame members 23 and 25 may be connected to non-parallel sides 19 and 21 in any manner which can be deemed suitable so long as members 23 and 25 serve to maintain sides 19 and 21 in a somewhat stretched or expanded condition. Further, any suitable suspension means 9 may be utilized for hanging chair 1 from overhead support 3. For example, suspension means 9 may comprise two chains which have one pair of adjacent ends attached to frame members 23 and 25 and their opposite adjacent ends secured to hooks 41 and 43. Ropes 11 and 31 may be made from either natural or synthetic materials.

Though overhead support 3 is depicted in the form of a ceiling or beam, it is entirely possible to utilize chair swing 1 of the present invention in conjunction with fixed or freely portable frame having an overhead bar or similar means for supporting suspension means 9.

Figure 5:
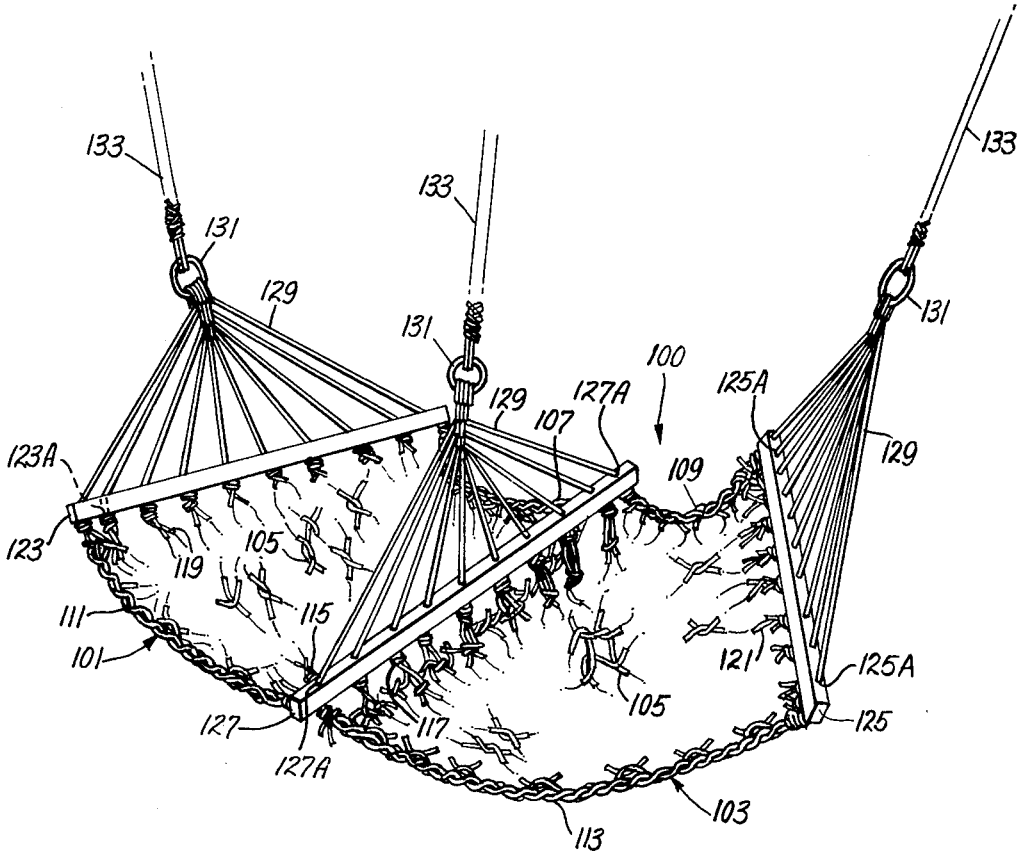
FIG. 5 is a perspective view of another embodiment of the hanging chair of the present invention.

Another embodiment of the hanging chair of the present invention is depicted in FIG. 5. Whereas chair 1 of the first embodiment is shown to provide seating for a single occupant, chair 100 of the second embodiment is intended to provide comfortable and secure support for two occupants. Chair 100 includes a pair of seats 101 and 103, with each having a substantially trapezoidal configuration and formed substantially of loosely woven material which permits the seats to expand in all directions. Seats 101 and 103 are preferably of an isosceles trapezoidal configuration and constructed of bias woven rope 105. However, it is understood that any other suitable flexible material, woven or unwoven, may also be utilized for forming seats 101 and 103 provided that such material is associated in such a manner as to provide flexible expansion in all directions.

Because of the trapezoidal configurations of seats 101 and 103, the shorter parallel sides thereof, as indicated at 107 and 109, are disposed rearwardly of chair 100 and define the back portion thereof. The longer parallel sides of seats 101 and 103, as indicated at 111 and 113, define the front portion of chair 100. Two adjacent non-parallel sides of seats 101 and 103, as indicated at 115 and 117, collectively define the juncture of seats 101 and 103 and the mid-section of chair 100. The remaining two non-parallel sides of seats 101 and 103, as indicated at 119 and 121, define the outer sides of chair 100.

An elongated frame member 123 is utilized for maintaining side 119 in a stretched condition. Similarly, an elongated frame member 125 is utilized for maintaining side 121 in a stretched condition. A third elongated frame member 127 is provided for maintaining adjacent sides 115 and 117 in a stretched condition. Portions of material 129, forming part of or carried by seats 101 and 103, may be passed through a plurality of apertures **123*a*, 125*a* and 127*a* provided in members 123, 125 and 127, respectively. Material 129 may then be collected and secured to a plurality of separate metal rings 131 and the latter may further be individually secured to a plurality of separate hanging means 133. Similar to chair 1 of the first embodiment, means 133 may each be advantageously provided with a metal ring (not shown), such as ring 37 and 39, at their free ends for the purpose of facilitating removable attachment of chair 100** to hooks or other suitable securing means carried by the overhead support.

Sides 107, 109, 111 and 113 may be formed from rope 105 or other suitable flexible material braided in a four-handed manner to impart rigidity thereto. Similarly, members 133 may also be formed from braided rope or other suitable flexible material. Frame members 123, 125 and 127 may be made from wood, plastic or any other suitable rigid material which permits such members to properly function in their stretching of non-parallel sides 115, 117, 119 and 121.

It is therefore evident that chair 100 is fully capable of providing the same comfortable and secure support for two occupants in the same basic manner as chair 1 of the first embodiment, except that chair 1 is only capable of supporting a single occupant. Entry into an exit from seats 101 and 103 is performed in the exact manner as described for chair 100.

Chair 100 is particularly useful in those situations wherein it is desired to provide seating for two occupants and physical space does not permit the utilization of two single chairs, with each having the structure of chair 1. Further, the unique structure of chair 100 requires only three hanging members 133 and three frame members 123, 125 and 127, thereby providing a more economical construction and utilization of materials than would be possible if one skilled in the art were required to construct two separate chairs, each having the structure of chair 1, for the purpose of fulfilling a seating requirement for two occupants.

It is to be understood that the embodiments of the invention herein shown and described are to be taken as preferred examples of the same, and that various changes in the shape, size, arrangement of parts and applications may be resorted to, without departing from the spirit of the invention or scope of the sub-joined claims.

I claim:

1. A chair for hanging from an overhead support, which chair comprises:

a. a pair of flexible seats, with each seat having a substantially trapezoidal configuration and formed substantially of loosely woven material which permits the seats to individually expand in all directions, wherein:

1. the back portion of the chair is defined by the shorter parallel sides of the seats,
2. the front portion of the chair is defined by the longer parallel sides of the seats,
3. the mid-section of the chair is defined by two adjacent non-parallel sides of the seats, and
4. the outer sides of the chair are defined by the remaining two non-parallel sides of the seats;

b. a frame member carried by the mid-section for joining the two non-parallel sides adjacent each other and maintaining the mid-section in a stretched condition, c. a frame member carried by each of the outer sides for maintaining the outer sides in a stretched condition; and d. means carried by the seats for hanging the chair from the overhead support.

2. The chair of claim 1 wherein each frame member includes a plurality of apertures through which portions of material carried by the seats are passed and secured to the means for hanging the chair from the overhead support.

3. The chair of claim 1 wherein each frame member is of an elongate configuration and collectively converge toward the back portion of the chair when the chair is hanging from the overhead support.

4. The chair of claim 1 wherein the material is bias woven rope.

5. The chair of claim 1 wherein the back and front portions of the chair are formed from rope braided in a four-handed manner for imparting rigidity thereto.

6. The chair of claim 1 wherein each seat is of a substantially isosceles trapezoidal configuration.

7. The chair of claim 1 wherein the means for hanging the chair from the overhead support includes at least three flexible elongated members having three adjacent ends carried by the seats.

8. The chair of claim 7 wherein the flexible elongated members are formed of braided rope.

9. The chair of claim 7 wherein the flexible elongated members are secured to the seats by a plurality of metal rings.

10. The chair of claim 7 wherein the three free ends of the flexible elongated members each include a metal ring for permitting removable attachment of the members to the overhead support.

* * * * *